United States Patent [19]

Becker

[11] 4,280,627

[45] Jul. 28, 1981

[54] HEAVY-DUTY CRANE WITH COUNTERWEIGHT

[75] Inventor: Rudolf Becker, Ehingen, Fed. Rep. of Germany

[73] Assignee: Liebherr-Werk Ehingen GmbH, Ehingen, Fed. Rep. of Germany

[21] Appl. No.: 1,074

[22] Filed: Jan. 5, 1979

[30] Foreign Application Priority Data

Sep. 12, 1978 [DE] Fed. Rep. of Germany ..... 2839665

[51] Int. Cl.[3] ..... B66C 23/72

[52] U.S. Cl. ..... 212/198; 212/197; 212/200

[58] Field of Search ..... 212/48, 49, 47, 46 A, 212/46 B, 197, 198, 200; 414/719

[56] References Cited

U.S. PATENT DOCUMENTS

| | | | |
|---|---|---|---|
| 3,930,583 | 1/1976 | Jouffray | 212/49 |
| 4,170,309 | 10/1979 | Lampson | 212/49 X |

FOREIGN PATENT DOCUMENTS

| | | | |
|---|---|---|---|
| 2448110 | 4/1976 | Fed. Rep. of Germany | 212/49 |

*Primary Examiner*—Robert G. Sheridan

*Attorney, Agent, or Firm*—Fleit & Jacobson

[57] ABSTRACT

In a heavy-duty crane particularly suitable for lifting heavy loads over tall buildings, a substructure supports a rotatable main boom. A jib for carrying the load and a secondary spar for carrying a counterweight by means of a cable are hinged to the tip of the main boom. The counterweight swivels together with turning of the loaded crane. The jib is guyed by way of the secondary spar which overhangs so far that the counterweight is disposed beyond the confines of the substructure.

6 Claims, 4 Drawing Figures

HEAVY-DUTY CRANE WITH COUNTERWEIGHT

The invention relates to a goliath crane comprising a heavy-duty jib and a counter-jib to which a counterweight is attached from a cable for counterbalancing purposes, the counterweight being swivellable together with turning of the loaded crane.

Known constructions operate with a counter-jib which is mounted on a turntable, as is the heavy-duty jib. A special counterweight is freely suspended from this counter-jib or is mounted on wheels. If, after the load is lifted, the crane is swivelled, the counterweight is also swivelled. Since the heavy-duty jib and the counter-jib are mounted on the turnable, the moments occurring in the crane are relieved, whereby considerable carrying forces and load moments can be achieved. If this crane incorporates an auxiliary or needle jib, the carrying forces for the needle are no higher than usual because the needle jib system is not counterbalanced by the counterweight construction.

If loads have to be lifted over buildings with conventional cranes without counterweight means, use is very often made of the heavy-duty jib/needle jib or main jib and auxiliary jib jib combination. However, the loads that can be lifted are relatively small.

To be able to lift a heavy load out of a tall building, a known crane equipped with counterweight means would require a very long heavy-duty jib and the latter would have to be of unduly heavy construction in relation to its dimensions in order to avoid buckling.

The invention is based on the problem of providing a crane having counterweight means and with which it is possible to lift heavy loads over tall buildings.

According to the invention, this problem is solved in a crane of the aforementioned class in that the counter-jib and a needle jib are hinged to the tip of the heavy-duty jib and the needle jib is guyed by way of the counter-jib, and that the counter-jib overhangs so far that the counterweight secured to it by the cable is disposed beyond the confines of the upper carriage of the crane.

Further embodiments of the invention are contained in the subsidiary claims.

The advantage achievable by means of the invention resides in that heavy loads can also be lifted in or out of a tall building(s).

The invention will now be explained by way of example with reference to the drawing, wherein.

Figure 1:
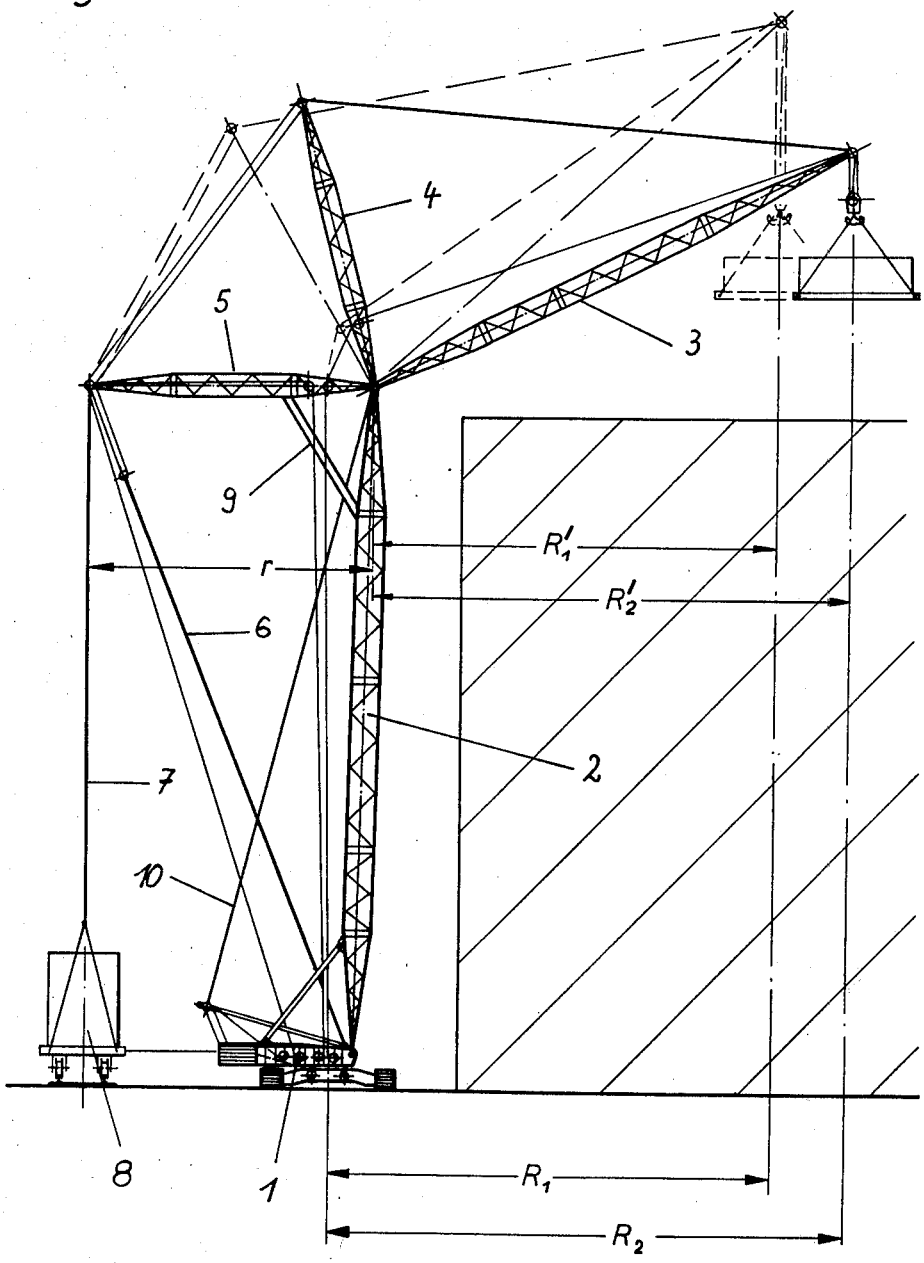
FIG. 1 illustrates an embodiment of the crane according to the invention wherein the counterweight is mounted on wheels.

The crane shown in FIG. 1 consists of an upper carriage 1 provided with ballast and having a heavy-duty jib 2 secured to it. A needle jib 3, an upper lever 4 and a counter-jib 5 are pivoted to its tip and the needle jib 3 is guyed by way of the upper lever 4 and the counter-jib 5. The jib system is held by way of the rear guy cable 6. A counterweight 8 is secured to the counter-jib 5 by means of a cable 7. The counter-jib can be held in a given position by a fall-back support 9.

If frequent loads are to be lifted successively, it is advantageous to mount the counterweight 8 on wheels.

The wheels may run on rails or be of solid rubber or pneumatic tyres. In this construction, the counterweight 8 is always taken along when the upper carriage 1 of the crane is swivelled, even when the crane is unloaded. For this the counterweight 8 must be of heavier construction to ensure that the counterweight 8 will remain on the wheels even when the crane is loaded. In this construction, the counterweight 8 can be designed for the largest load, whereby the crane will always be ready for large and small load moments and a change in the overhang $R'_1$ of the needle jib 3 will also be possible when the crane is loaded.

Figure 2:
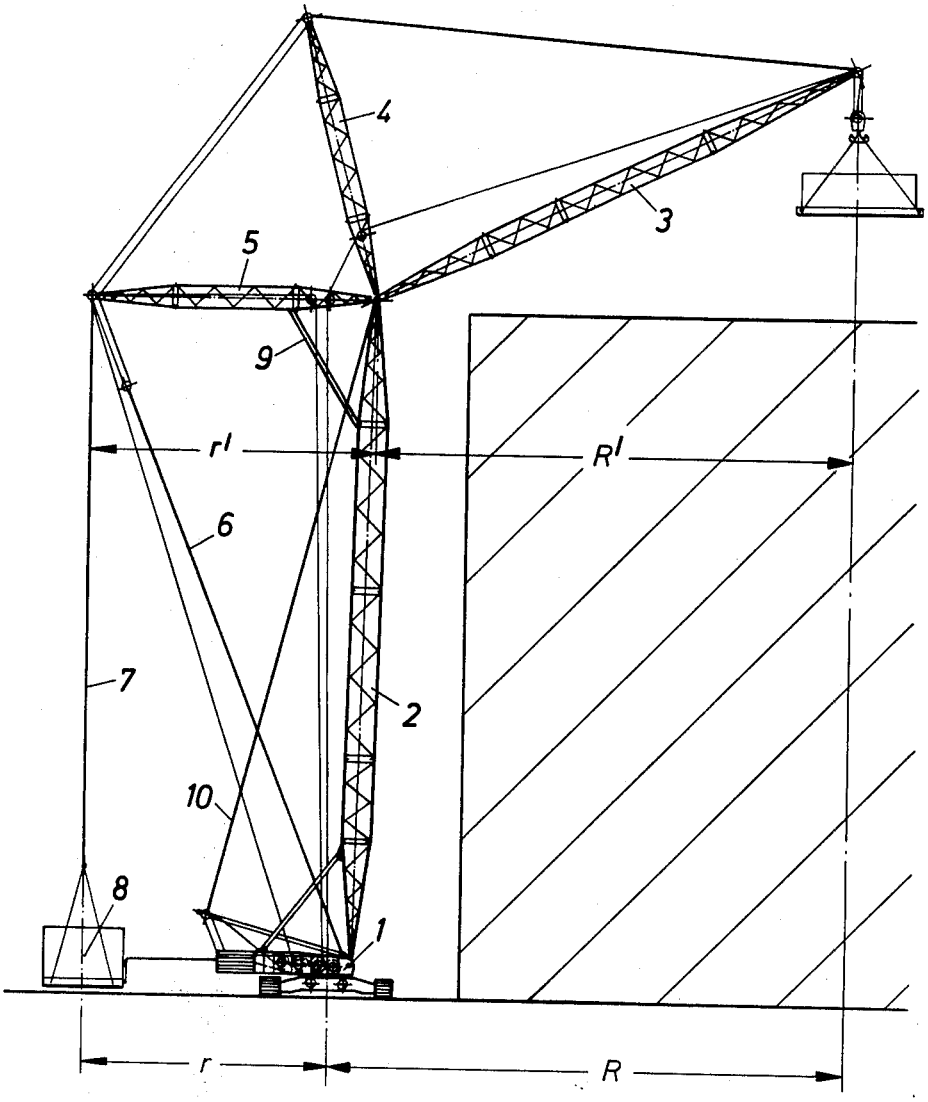
FIG. 2 shows an embodiment in which the counterweight is freely suspended when the crane is loaded.

A freely suspended counterweight 8 according to FIG. 2 is of particular advantage if a one-off load is to be lifted, because the counterweight 8 will have a different position after swivelling and depositing of the load and a return to the original position is not necessary. In this construction operation of the crane is possible only if the load and counterweight moments have a balanced relationship to each other, the counterweight moment always being somewhat less than the load moment. Differences in the counterweight moment are taken up by the bracing cable 10 of the heavy-duty jib 2. A change in the overhang $R'_1$ of the needle jib 3 is not possible when the crane is loaded.

Figure 3:
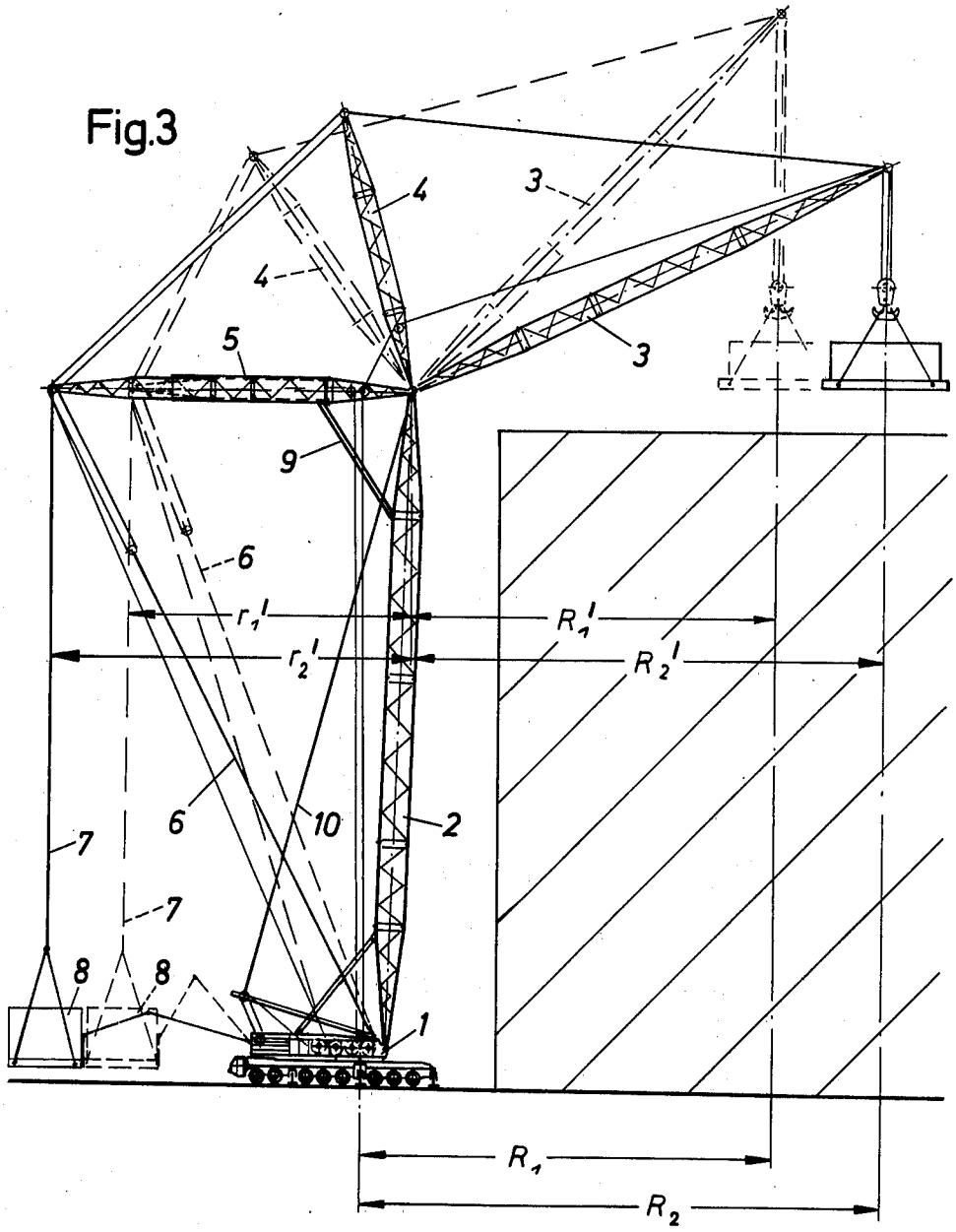
FIG. 3 shows a crane according to the invention having a telescopic counter-jib.
Figure 4:
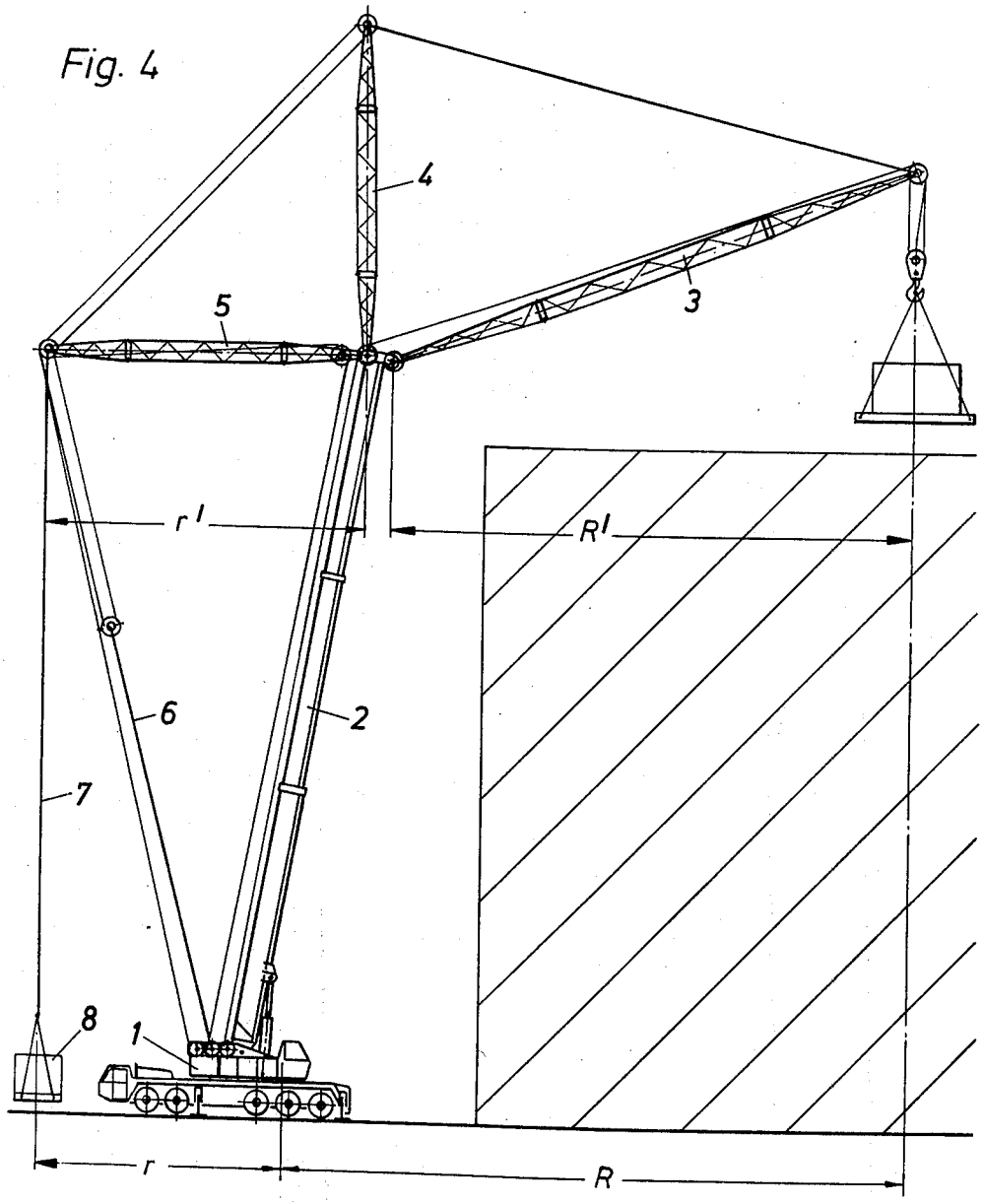
FIG. 4 illustrates a telescopic crane according to the invention.

In case such a change is necessary, the FIG. 3 embodiment provides for the counter-jib 5 to be telescopic so that, when for example the load is swung out with an increase in the overhang, the counter-jib 5 can also be telescopically extended. One thereby retains the ratio of the load moment to the counterweight moment even when the overhang $R'_1$ is changed to $R'_2$ and the overhang of the counter-jib 5 is changed from $r'_1$ to $r'_2$. Telescopic extension can be effected by a hydraulic cylinder or a cable mechanism.

The embodiments of FIGS. 1 to 3 all represent lattice boom cranes which, depending on the construction of the substructure, can be stationary cranes or vehicle cranes. The vehicle cranes can therefore be mounted on vehicle, mobile, caterpillar or rail undercarriages. The turning radius or overhang of the tower in relation to the tip of the tower can be operatively adjustable as is generally the case in mobile cranes. However, it may also be anchored in position as is usual for rotary tower cranes.

The solution according to the invention can be applied to telescopic cranes in a simple manner. Whereas in lattice boom cranes the jib is assembled in the deposited position and must then be erected, the contractability of the telescopic jib makes assembly even simpler. However, the same principle of construction is possible as for lattice boom cranes.

There will now follow a more detailed explanation of the function of the crane according to the invention.

To begin with, the crane is unloaded. The jib system is held by the rear bracing cable 6 by way of the upper lever 4 and the counter-jib 5, the moments acting in the direction of the jib being predominant. On lifting the load, the counterweight 8 is simultaneously pulled up by relaxing the rear bracing cable 6. By means of measuring equipment in the bracing cable of the main jib one can ensure that balance is being maintained. If there is overbalance or insufficient balancing, the crane will be switched off at the upper or lower limiting load. When the full load is suspended from the crane, there must also be full compensation by the counter-weight 8. Lowering of the load takes place in a manner conversely to that during lifting.

I claim:

1. A goliath crane comprising a rotatable upper carriage, a heavy-duty jib supported by the upper carriage, a telescopic counter-jib hinged to an upper tip of said heavy-duty jib, a counterweight, a cable attaching the counterweight to the counter-jib for counterbalancing purposes, means for interconnecting the upper carriage and counterweight so that the counterweight is movable towards and away from the upper carriage in conjunction with telescopic movement of said counter-jib, the counterweight being swivellable by turning of the upper carriage, a needle jib hinged to the tip of the heavy-duty jib, means disposed between the counter-jib and needle jib for guying the needle jib from the counter-jib, the counter-jib overhanging the upper carriage so far that the counterweight secured to it by the cable is diposed beyond the confines of the upper carriage of the crane, the counterweight being spaced from the upper carriage and being supported by the cable in such manner that the counterweight exerts no force on the upper carriage when the crane is unloaded.

2. A goliath crane according to claim 1, said means for guying comprising an upper lever hinged to the upper tip of said heavy duty jib, the needle jib being guyed by way of the upper lever.

3. A goliath crane according to claim 1 or claim 2, characterised in that the counterweight is suspended freely by the cable.

4. A goliath crane according to claim 1 or 2, characterised in that the heavy-duty jib is a telescopic jib.

5. A goliath crane according to claim 1 or claim 2, further comprising a guy cable extending between the upper carriage and an end of the counter-jib spaced from the upper tip of the heavy-duty jib for holding the heavy-duty jib, counter-jib, and needle jib when the crane is unloaded, said guy cable being relaxed on lifting of a load so that the counterweight exerts a force on said counter-jib.

6. A goliath crane according to claim 5, further comprising a fall-back support extending between the heavy-duty jib and counter-jib for holding the counter-jib in a predetermined position.

* * * * *